US006295653B1

(12) United States Patent
Puleo

(10) Patent No.: US 6,295,653 B1
(45) Date of Patent: Oct. 2, 2001

(54) HELMET PROVIDING IMPROVED FRONTAL AND PERIPHERAL VIEW

(76) Inventor: Michael Puleo, 79-44 261st St., Floral Park, NY (US) 11004

( * ) Notice: Subject to any disclaimer, the term of this patent is extended or adjusted under 35 U.S.C. 154(b) by 0 days.

(21) Appl. No.: 09/070,141

(22) Filed: Apr. 30, 1998

Related U.S. Application Data

(63) Continuation-in-part of application No. 29/077,656, filed on Oct. 8, 1997, now Pat. No. Des. 411,900.

(51) Int. Cl.[7] ..... A42B 3/00
(52) U.S. Cl. ..... 2/424
(58) Field of Search ..... 2/6.3, 6.7, 410, 2/411, 414, 424, 425, 10

(56) References Cited

U.S. PATENT DOCUMENTS

| | | | |
|---|---|---|---|
| D. 283,940 | 5/1986 | Bally | D2/232 |
| D. 323,225 | 1/1992 | Gallet | D29/17 |
| 3,991,422 | 11/1976 | Saotome | 2/410 |
| 4,028,743 | 6/1977 | Christensen | 2/424 |
| 4,209,858 | 7/1980 | Coenen | 2/412 |
| 4,291,418 | 9/1981 | Zeisler | 2/410 |
| 5,575,018 | 11/1996 | Rothrock et al. | 2/424 |
| 5,669,079 | 9/1997 | Morgan | 2/414 |

OTHER PUBLICATIONS

Bell Auto Racing Helmet Advertisement, copyright date 1996.

AGV Q3R Helmet Review (date unknown).

AGV R3 Helmet Advertisement (date unknown).

*Primary Examiner*—Michael A. Neas
(74) *Attorney, Agent, or Firm*—Michael I. Kroll

(57) ABSTRACT

The helmet of the present invention comprises an outer and inner shell having a top, a front, a rear, and left and right sides corresponding to wearer's crown, face, rear and left and right sides, respectively. The front of the helmet has an enlarged view window that exposes at least a portion of the wearer's face. The view window has an upper rim, lower rim, right rim, and left rim. The lower rim extends from the front of the helmet to about the auditory canal. The upper rim is separated from the lower rim and loosely tracks the path of the lower rim. The upper rim is connected to the lower rim on both the left and right sides by left and right rims, respectively. A step is formed in the lower rim as it proceeds towards the back of the view window. This increases the wearer's view of the road. The upper rim is connected to the lower rim on both the right and left sides by the right and left side rims, respectively. The side rims have a straight slant that extends backwards from bottom to top. In addition, a portion of the inner padding located on the right and left sides of the helmet is reduced in thickness thereby increasing the peripheral vision of the wearer. The reduced padding also eliminates virtually all blind spots that are associated with conventional helmets. Narrow portions are carved into the outer shell of the helmet starting from left and right rims of the view window and extend to the middle to rear of the helmet. The narrow portions start off deep and gradually resurface at the middle to the rear of the helmet.

6 Claims, 8 Drawing Sheets

HELMET PROVIDING IMPROVED FRONTAL AND PERIPHERAL VIEW

RELATED APPLICATION

This application is a continuation-in-part of Design patent application Ser. No. 29/077,656 entitled HELMET and filed on Oct. 8, 1997, for Michael Puleo now U.S. Pat. No. Des. 411,900.

BACKGROUND OF THE INVENTION

1. Field of the Invention

This invention relates to helmets, and more particularly, to helmets worn by vehicle racing professionals and amateurs, and recreational users of motorcycles, open and closed cockpit racing vehicles, racing boats, and jet aircraft.

2. Description of the Background Art

Helmets in various forms have been used throughout history to protect the cranial area of the wearer. Full head helmets usually have an open portion in the front of the helmet to allow the wearer to see. This open portion is hereinafter referred to as the view window. These helmets may be equipped with a face shield or visor that deflects on-coming wind and protects the wearer's face and eyes. The shape of the helmet relates to the amount of aerodynamic drag that the wearer experiences. Therefore, different shapes have been developed over recent years to reduce aerodynamic drag of the helmet as it is exposed to the effects of the air flowing through, for example, the cock-pit of a car or over the windshield of a motorcycle.

Recent advancements in motorcycles, race cars, speed boats, and jet aircraft have enabled these vehicles to reach excessive speeds. In fact, a new car produced by a major car company has recently entered the record books for breaking the sound barrier on dry land. At such high speeds, the time allowed to make navigational decisions is minimal.

To a speed racer, concentration is of the utmost importance. Piloting a speeding vehicle requires a high degree of hand-eye coordination especially for those operating a motorcycle. Seeing upcoming traffic or racing opponents helps ensure his or her safety. Motorcycle users are particularly susceptible to serious injury due to unseen traffic because they do not have a steel shell to protect them from errant motorists or even their own mistakes. Moreover, driving a motorcycle which cannot stand by itself as it hurtles across twisting pavement at ultra high speed is serious business. The wrong decision may lead to severe injury or even death of the driver, passengers, or other persons. Therefore, having as broad a field of view as possible, particularly frontal and peripheral, is essential in making life or death split-second navigational decisions.

Many changes have been made in the design of helmets in the past years. These changes include airduct ventilation systems, visor attachments, helmet padding, shell composition, etc. Many of these changes make the helmet more aerodynamic, light weight, and/or comfortable when worn, yet do not increase the wearer's field of view, particularly frontal and peripheral, when wearing the helmet. Having a clear view of the road is crucial in maneuvering the vehicle safely, particularly when moving at high speed. For example, when competing in a race, a high speed racer may change position on a straightaway while other racers, also traveling at high speed, may be to the left and right of the racer. A racer, such as a motorcycle racer, may be in a "racing tuck" on curves. When in a racing tuck, the racer is at a steep angle with respect to the ground, thus making peripheral vision particularly important. Existing helmets have many blind spots that obstruct the wearer's field of view, especially in the sides of the helmet at eye level. These blind spots result from a thick inner padding and/or a small frontal opening of the helmet.

The purpose of this inventive helmet is to help increase the concentration level of users of speed vehicles by eliminating the obstacle of blind spots when wearing their protective helmet, particularly in frontal and peripheral views. As the speed of vehicles continues to increase, so must the technology of protective gear such as helmets. One cannot exist without the other in order to ensure the user's safety when operating speed vehicles.

Therefore, it is an object of the present invention to provide a helmet which provides a broader range of frontal and peripheral vision than previous helmets have provided while maintaining the strength of the helmet.

SUMMARY OF THE INVENTION

The inventive helmet solves the above stated problems. The inventive helmet provides a wearer with a greater frontal and peripheral view. This is achieved by a unique structure of the lower and side rims and by narrowing the thickness of the helmet at the side rims at a location near the wearer's eye level.

The inventive helmet comprises an outer shell and an inner shell. The front of the helmet has a view window which exposes at least a portion of the wearer's face. The view window is defined by an upper rim, a lower rim, a right rim, and a left rim.

The lower rim extends from the front of the helmet to about the wearer's auditory canal. The upper rim is separated from the lower rim and loosely tracks the path of the lower rim. The upper rim is connected to the lower rim on both the right and left sides by the right and left rims, respectively. The lower rim drops in at least a single step fashion at locations substantially below each of the wearer's eyes as it extends towards the rear of the view window. This structural design increases the wearer's frontal field of view without compromising the strength and/or safety of the helmet.

The side rims at the rear of the view window are not of the same configuration of the conventional speed helmet. The rear of the view window of conventional speed helmets are rounded. The side rims of the inventive helmet preferably have a straight slant that extends backwards from bottom to top toward the front of the auditory canal and then at about eye level angles forward to the top rim of the view window. Preferably, the deepest portion of the view window is located at approximately the wearer's eye level. Alternatively, the rear of the view window angles straight back. These preferred structures maximize the wearer's view of the road without reducing a large amount of the shell and padding of the helmet. This structural design increases the wearer's frontal and peripheral fields of view.

In addition, a portion of the inner padding located on the right and left sides of the inventive helmet is minimally reduced in thickness so as to eliminate any blind spots and increase the wearer's field of view. The inventive helmet comprises areas of reduced inner padding as well as narrow portions formed in the outer shell of the helmet which increase the wearer's frontal and peripheral fields of view. The minimally reduced thickness of the inner padding and the narrow portions eliminate the blind spots found in prior art helmets. This is achieved by narrowing the sides of the helmet from a narrow portion at the view window which becomes less narrow towards the middle to back of the helmet. Preferably, this area of reduced thickness is located substantially at a wearer's eye level. The narrow portion may preferably "resurface" to the conventional helmet thickness at about the middle to rear of the side of the helmet. This preferred structure maximizes the user's frontal and peripheral fields of view without significant reduction in the protective properties of the helmet. Accordingly, the blind spots usually associated with conventional helmets are virtually eliminated.

This increased field of view allows the wearer to have a better peripheral view of the road. This may enable the wearer to make split-second driving decisions. For example, the inventive helmet decreases the chance of an accident occurring because the driver lost sight of an object in the blind spots associated with conventional helmets.

BRIEF DESCRIPTION OF THE DRAWINGS

The present invention is described with reference to the following figures.

DETAILED DESCRIPTION OF THE INVENTION

The preferred embodiments of the invention are illustrated in the attached drawings which are referred to herein. The same reference numbers will be used to identify identical structures throughout the drawings.

Figure 1:
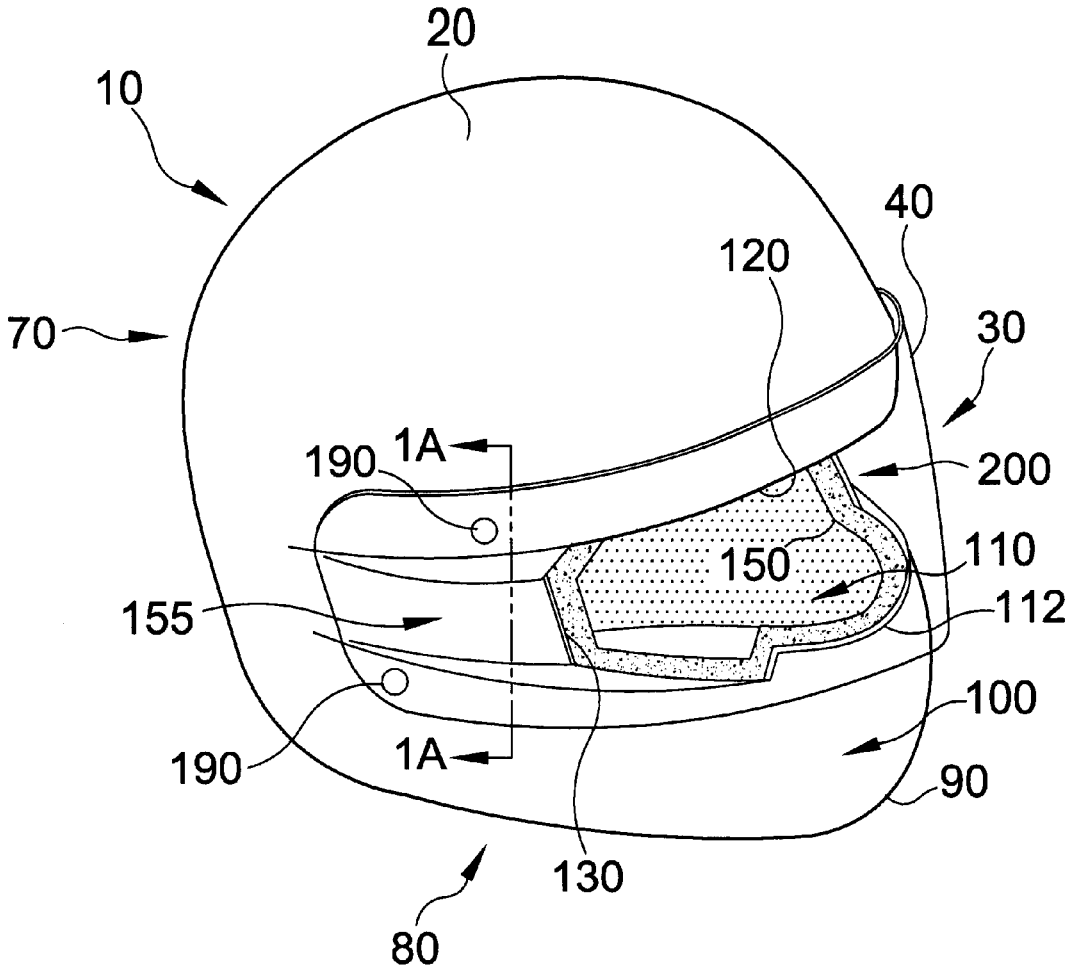
FIG. 1 is a perspective view of a preferred embodiment of a helmet according to the present invention.

FIG. 1 illustrates a preferred embodiment of a helmet 10 according to the present invention. The helmet 10 shown in FIG. 1 has a top portion 20, a front portion 30, a rear portion 70, and a bottom portion 80. The bottom portion 80 has a ramus portion 100 that extends from the lower part of the rear portion 70 to the chin portion 90 of the helmet 10. The helmet 10 may be fitted with a visor 40 that is attached to the right side 50 and the left side 60 (shown in FIG. 2) of the helmet 10 by facets 190.

The helmet 10 shown in FIG. 1 also has a view window 200 in the frontal portion of the helmet that corresponds to the face of the wearer. The view window 200 is defined by an upper rim 120, a lower rim 110, and right and left side rims 130, 150. The upper rim 120 of the view window 200 extends from the front portion 30 of the helmet to the right side 50 and the left side 60 of helmet 10.

As the lower rim 110 of the view window 200 extends from the front portion 30 to the right side 50 and left side 60 of the helmet 10, the lower rim 110 at a location substantially below each of the wearer's eyes drops in at least a single step fashion. Therefore, a portion 112 of the lower rim 110 covering the wearer's oral area is higher than the rest of the rim. Thus, the wearer's view is not obstructed by the rim or padding on the inside of the helmet. This structural design increases the wearer's field of view, but at the same time protects the wearer's oral area in case of impact.

Figure 1A:
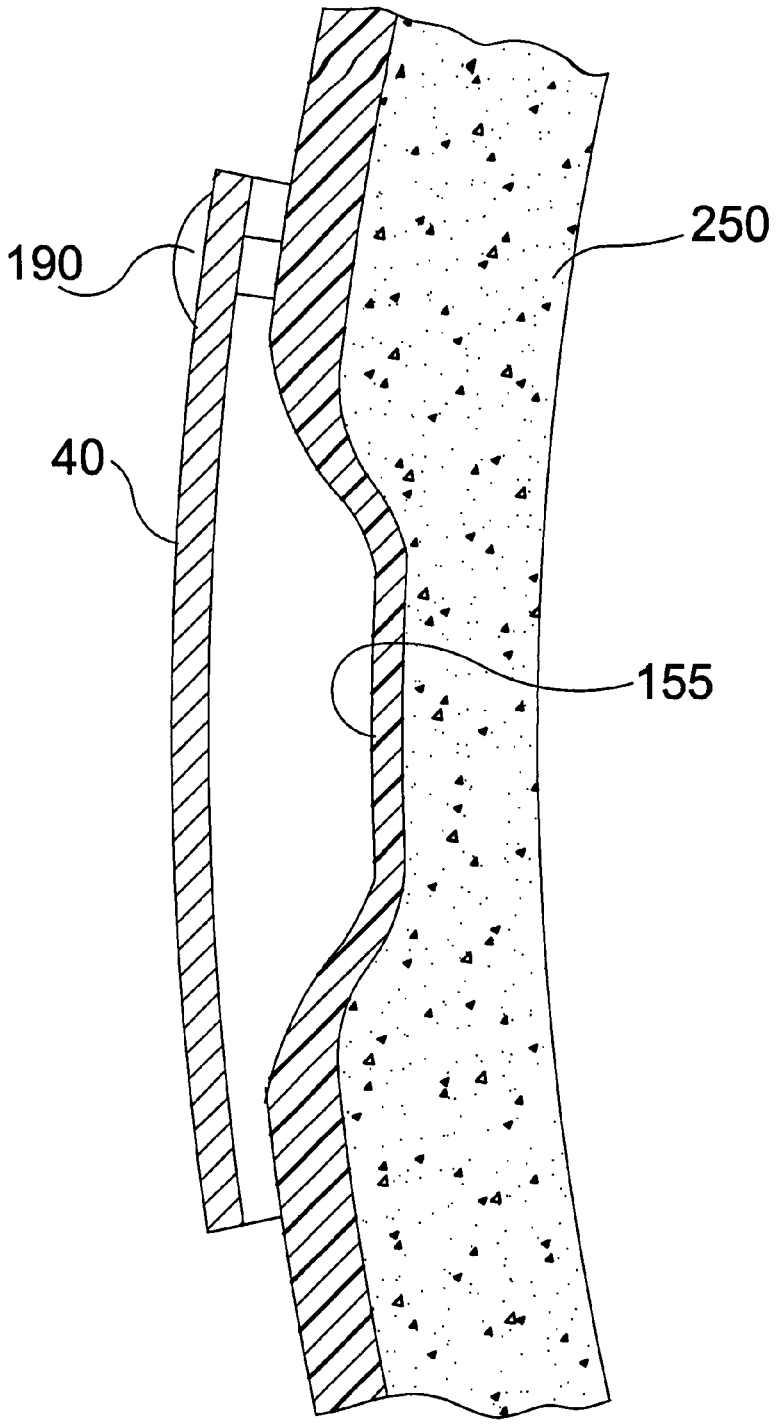
FIG. 1A is a cross-sectional view thereof taken along line 1A—1A of FIG. 1.

On each side of the helmet beginning at about the right and left rims 130, 150 and at the wearer's eye level are narrowed portions 155, 160. These narrowed portions reduce the thickness of the helmet at an area of the wearer's peripheral view. FIG. 1A shows a cross-sectional view of the helmet 10 taken along line 1A—1A of FIG. 1. FIG. 1A shows that the inner padding 250 is thinner in the narrowed portion 155 than the surrounding portions of the inner padding. The thinner portion of the inner padding gradually increases in thickness so that it is substantially the same thickness as the padding of surrounding portions of the helmet as it approaches the middle to rear portion 70 of the helmet 10.

Where the inner padding is thinner, narrow portions 155 and 160 are formed in the outer shell. These narrow portions track the path of the thinner inner padding. The narrow portions 155, 160 gradually increase in thickness as they approach the middle to rear portion 70 of the helmet 10 until they are substantially the same thickness as surrounding portions of the helmet so as to blend with the outer surface of the helmet at a location behind the wearer's auditory canal.

The reduced thickness of the padding and the narrow portions 155, 160 of the outer shell of the helmet 10 increase the wearer's peripheral view of the road. This structural design reduces the number of blind spots frequently associated with conventional helmets. Reducing the number of blind spots in a helmet 10 gives the wearer a greater field of view and therefore increases the safety of the driver. These narrow portions 155, 160 in conjunction with the step down cut in the lower rim 110 of the view window 200 provide a maximum field of view frontal and peripheral and thus a maximum view of the road without decreasing the safety of the helmet.

Figure 2:
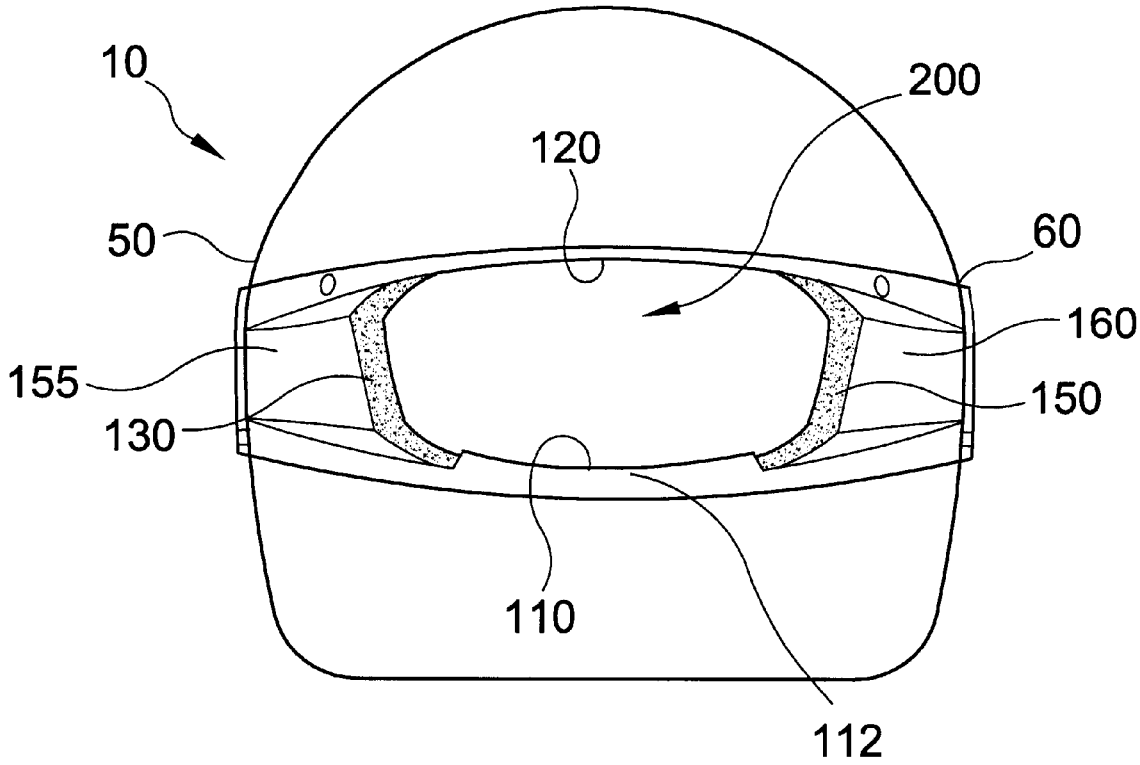
FIG. 2 is a front view thereof.

FIG. 2 shows the narrow portions 155, 160 located on both the left and right sides of the helmet. As shown these narrow portions are indented at the view window 200 and gradually raise to the surface of the helmet behind the auditory canal.

Figure 3A:
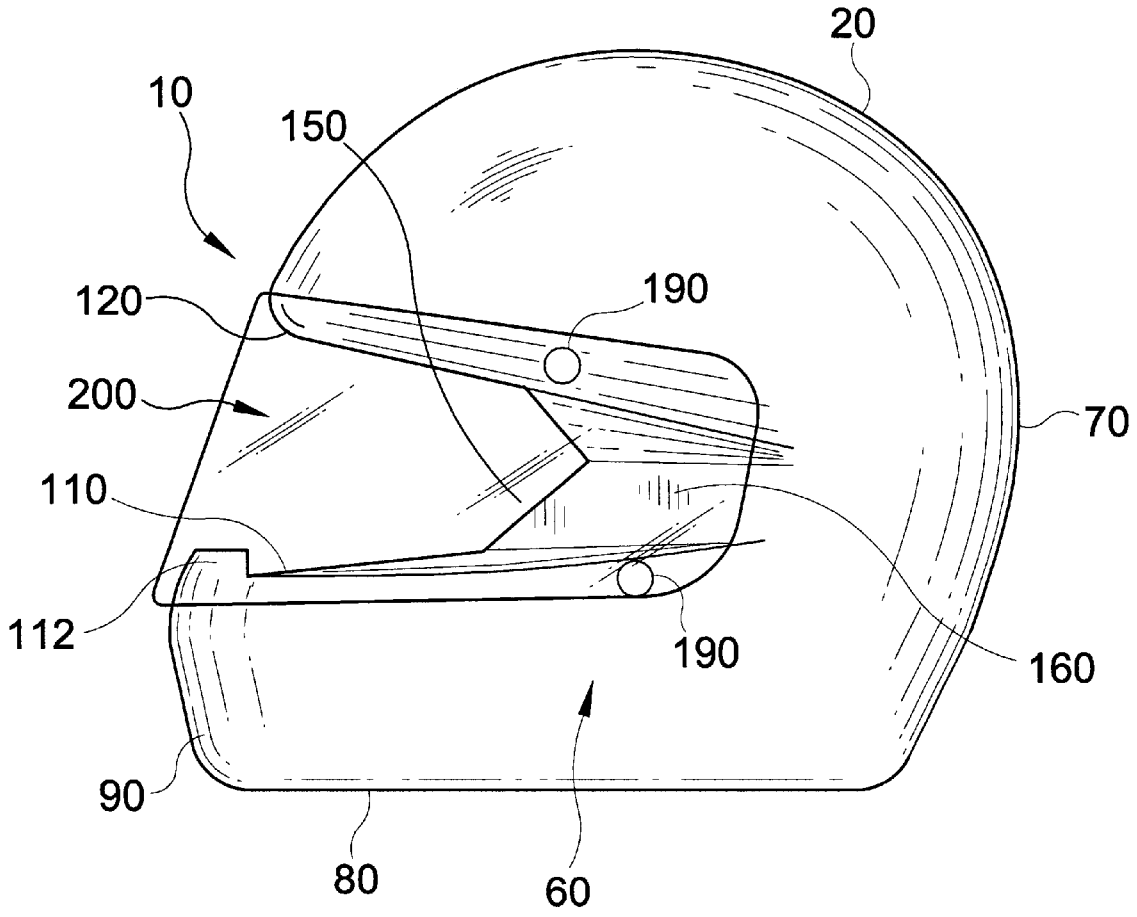
FIG. 3A is a side view of a first preferred embodiment thereof.

FIG. 3A shows the left side of the helmet 10. It can be seen that the narrowed portion 160 starts off indented and gradually rises to the surface of the outer shell so that it is substantially the same thickness as the surrounding portion of the helmet. It can be seen from this illustration that the front portion of the lower rim 110 is high enough to provide protection of the oral cavity of the wearer in case of impact.

Figure 3B:
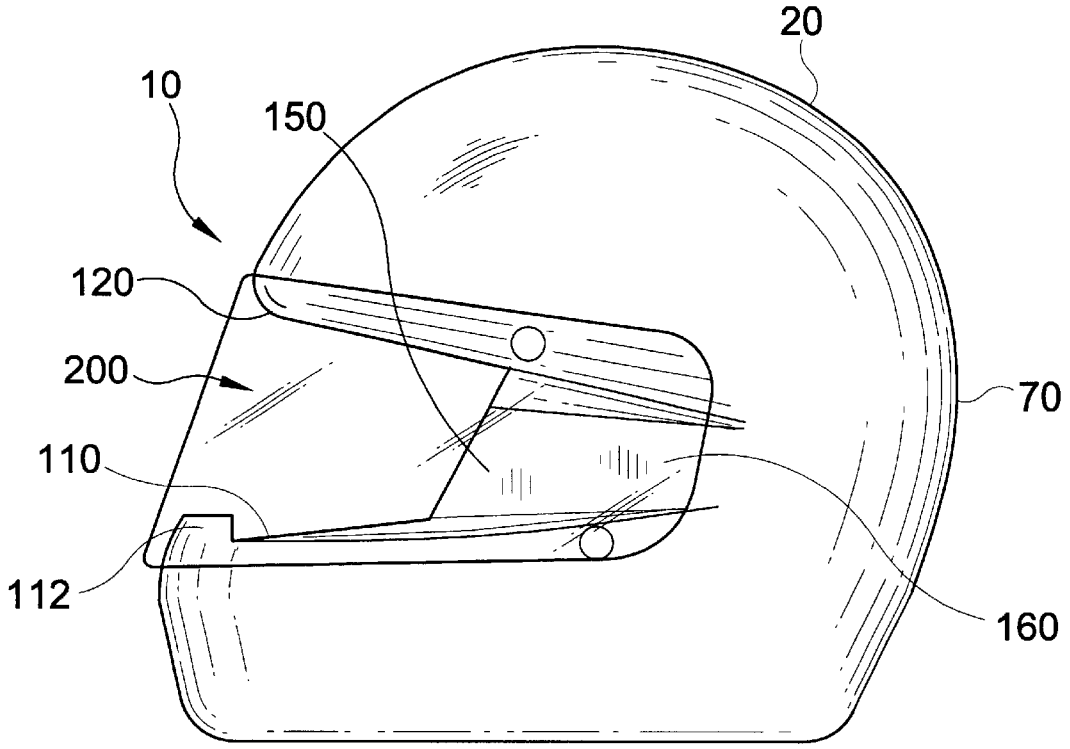
FIG. 3B is a side view of a second preferred embodiment thereof.

FIG. 3A also shows the left side rim 150. The shape of the side rims provides an important structural advantage in increasing the wearer's peripheral view. The side rim 150 preferably has a straight slant that angles backwards from bottom to top so that, at the wearer's eye level, the slant extends to a location approximately corresponding to the front of the wearer's auditory canal. In one embodiment seen in FIG. 3A, the deepest portion of the view window is located at approximately the wearer's eye level. That is, the straight slant extends towards the front of the wearer's auditory canal at about eye level and then angles forward towards the top rim 120. This provides maximum peripheral vision without a great reduction in protective area covering the wearer's head. FIG. 3B shows an alternative embodiment wherein the side rim 150' has a straight slant which extends backwards toward the wearer's auditory canal and then continues backwards until it meets the top rim 120 of the view window. Thus, the right and left rims 130, 150 (and 150') define a view window 200 which provides an unobstructed view at the wearer's eye level.

Figure 4:
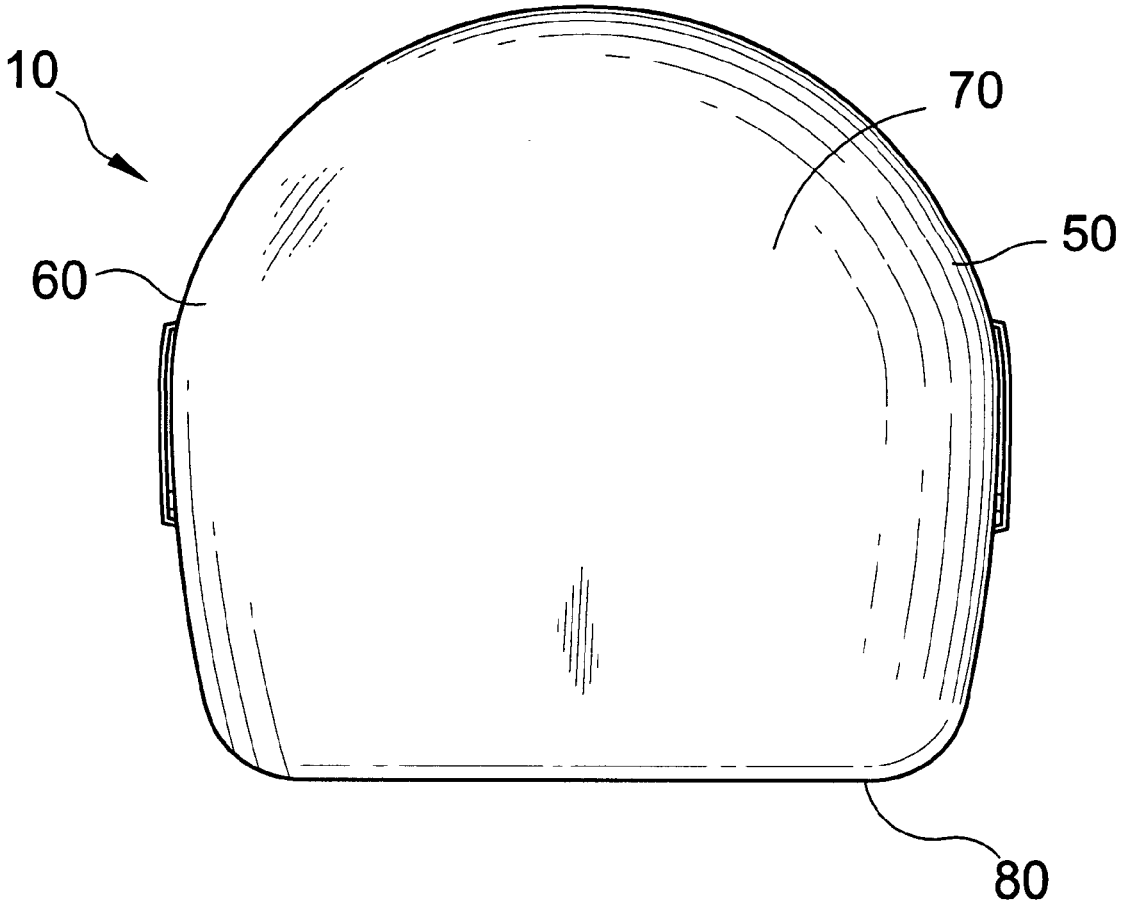
FIG. 4 is a back view thereof.

FIG. 4 shows the back of the helmet.

Figure 5:
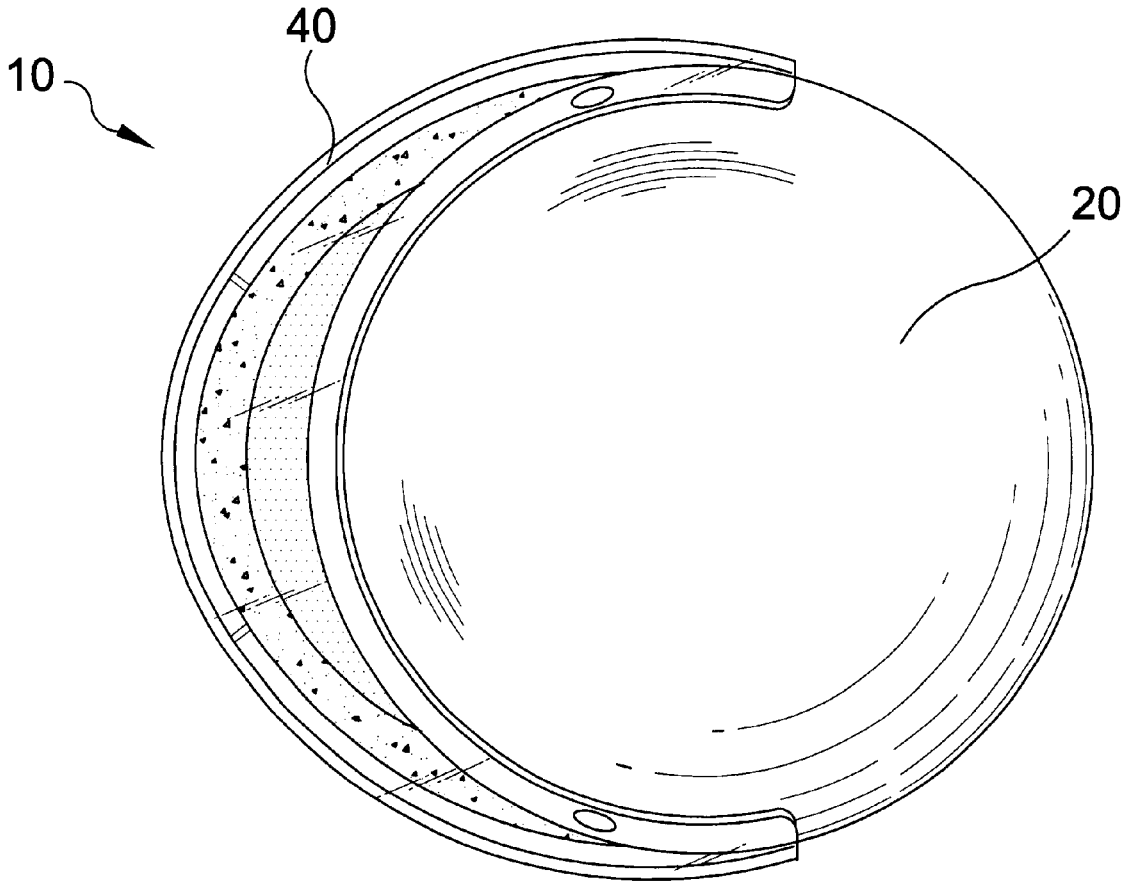
FIG. 5 is a top view thereof.

FIG. 5 shows the helmet from above, including the attachment of the visor 40. The top of the helmet may be similar to a conventional helmet. The visor 40 may be attached to the helmet in any suitable manner, as is apparent to those skilled in the art.

Figure 6:
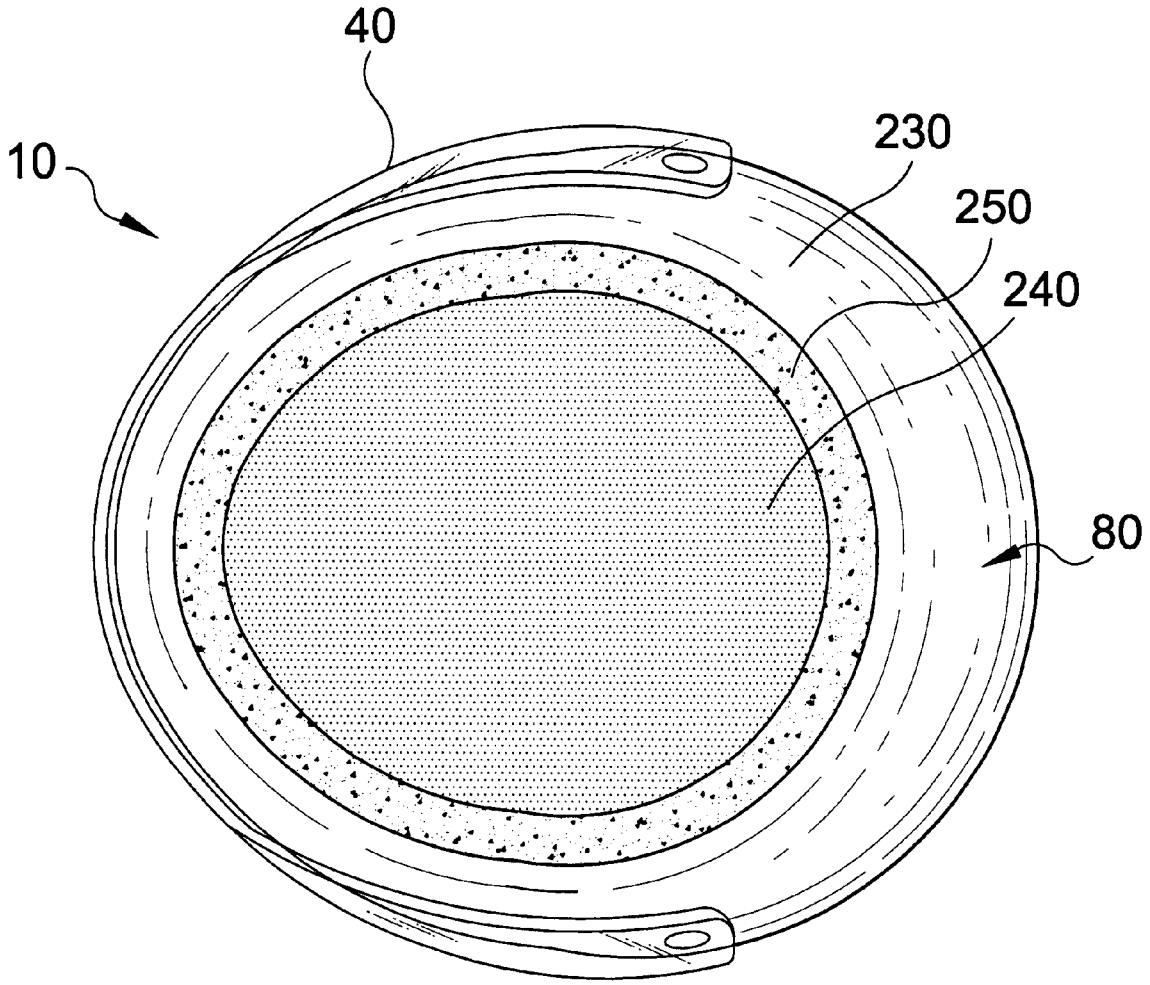
FIG. 6 is a bottom view thereof.

FIG. 6 shows the bottom portion 80 of the helmet and the visor 40. In this orientation, it can be seen that the padding 250 is "sandwiched" between the outer shell 230 and an inner shell 240. Various degrees of padding may be used in different helmets. For example, the present invention may be used with "fat boy" type helmets having thick padding. Indeed, the narrowed portions 155, 160 are particularly advantageous for the "fat boy" type helmet because it provides increased peripheral vision otherwise lost due to the thick padding obstructing the wearer's peripheral vision.

It is an object of the inventive helmet when worn to give the user the visual feeling as if he or she is not wearing a helmet at all. This feeling occurs as the result of no visible parts seen from the inside of the view window by the wearer, both frontal and peripheral. For over 25 years, the shell of the speed helmet has been substantially unmodified from its original form/shape. The main intention of helmet manufacturers is to develop a helmet for safety. However, existing designs sacrifice a better view, frontal and peripheral, by the use of thick padding and a small width view window. Thus, the goal of a helmet maximizing safety—including providing the best possible frontal and peripheral view when worn—had not been achieved by the prior art. This inventive helmet protects the user's cranial area in conjunction with giving the user a feeling of confidence knowing that his/her view of the road is the same as if not wearing a helmet at all. This helmet greatly reduces the distractions caused by the wearer's eyes focusing on the inside of the view window on both padding and rim when operating the vehicle.

Moreover, the helmet may be manufactured in any suitable manner in which helmets are conventionally made. Preferably, the helmet may be made of materials used in conventional helmets. For example, the helmet may have a polycarbonate shell or may have a multi-layered fiberglass design. The helmet may use conventional padding material. The visor may be made of Lexan, injection molded acrylic, or other suitable material.

Although the major features of the unique helmet have been described above, it should be understood that various changes of details, materials, arrangements of parts and uses which have been herein described and illustrated in order to explain the nature of the invention will occur to and may be made by those skilled in the art upon their reading of this disclosure, or upon their seeing of an embodiment of the invention described herein, and such changes are intended to be included within the principles and scope of the invention. For example, the helmet has been described for use with motorcycles, automobiles, boats, and aircraft. However, a person skilled in the art readily recognizes that this invention may be used for any type of full-head helmet, such as fighter pilots and the like.

I claim:

1. A helmet configured to provide peripheral vision to a wearer, said helmet having a view window defined by a top rim, a bottom rim, a left rim and a right rim, said left and right rims extending from said bottom rim to said top rim backwards at an angle, said left and right rims defining sides of said view window configured to provide an unobstructed view at the wearer's eye level, said helmet further comprising left and right narrow portions from said left and right rims, respectively, and located substantially at the wearer's eye level, said narrow portions having a narrowed thickness at said left and right rims and increasing in thickness as said narrow portions approach a middle to rear of said helmet so as to have substantially a same thickness as surrounding portions of said helmet and wherein said lower rims has at least one step formed therein on both sides at a location substantially corresponding to a location of the wearer's oral cavity, said step extending backwards toward said left and right rims.

2. The helmet of claim 1, wherein said at least one step on both sides is located below each of the wearer's eyes.

3. The helmet of claim 1, wherein said step is configured to provide an improved frontal view to the wearer.

4. A helmet configured to provide improved peripheral vision to a wearer, the helmet having a view window defined by a top rim, a bottom rim, a left rim, and a right rim, the helmet comprising left and right narrowed portions having a narrowed thickness at the left and right rims substantially at the eye level of the wearer, wherein the lower rim has at least one step formed in the lower rim on both sides at a location substantially corresponding to a location under each of the wearer's eyes and of the wearer's oral cavity, said step extending backwards towards the left and right rims.

5. The helmet of claim 4, wherein the narrowed portions increase in thickness as they move towards a middle of the helmet so as to have substantially a same thickness as surrounding portions of the helmet.

6. The helmet of claim 4, wherein the at least one step is configured to provide improved frontal view to the wearer.

* * * * *